US007219655B2

(12) United States Patent
Shinogle

(10) Patent No.: US 7,219,655 B2
(45) Date of Patent: May 22, 2007

(54) FUEL INJECTION SYSTEM INCLUDING TWO COMMON RAILS FOR INJECTING FUEL AT TWO INDEPENDENTLY CONTROLLED PRESSURES

(75) Inventor: Ronald D. Shinogle, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 168 days.

(21) Appl. No.: 10/377,330

(22) Filed: Feb. 28, 2003

(65) Prior Publication Data

US 2004/0168673 A1 Sep. 2, 2004

(51) Int. Cl.
*F02M 69/46* (2006.01)
*B05B 1/30* (2006.01)

(52) U.S. Cl. ..... 123/456; 123/467

(58) Field of Classification Search ..... 123/456, 123/457, 446, 458, 497, 467; 239/585.5
See application file for complete search history.

(56) References Cited

U.S. PATENT DOCUMENTS 4,069,800 A 1/1978 Kanda et al.
4,118,237 A 10/1978 Beall et al.
4,440,132 A 4/1984 Terada et al.
4,603,671 A 8/1986 Yoshinaga et al.
5,413,076 A 5/1995 Koenigswieser et al.
5,458,292 A 10/1995 Hapeman
5,463,996 A 11/1995 Maley et al.
5,601,067 A 2/1997 Wirbeleit et al.
5,622,152 A 4/1997 Ishida
5,651,345 A 7/1997 Miller et al.
5,669,355 A 9/1997 Gibson et al.
5,673,669 A 10/1997 Maley et al.
5,682,858 A 11/1997 Chen et al.
5,687,693 A 11/1997 Chen et al.
5,697,342 A 12/1997 Anderson et al.
5,711,274 A * 1/1998 Drummer ..... 123/456
5,738,075 A 4/1998 Chen et al.
5,826,562 A 10/1998 Chen et al.
5,899,389 A 5/1999 Pataki et al.
6,026,785 A 2/2000 Zuo (Continued)

OTHER PUBLICATIONS

Bernd Mahr, Manfred Dürnholz, Wilhelm Polach, and Hermann Grieshaber, Robert Bosch GmbH, Heavy Duty Diesel Engines - The Potential of Injection Rate Shaping for Optimizing Emissions and Fuel Consumption Stuttgart, Germany, at the 21st International Engine Symposium, May 4-5, 2000, Vienna, Austria.

*Primary Examiner*—Hai Huynh
(74) *Attorney, Agent, or Firm*—Liell & McNeil

(57) ABSTRACT

Engineers have come to learn that a fuel injection system with a variety of capabilities to produce a variety of injection strategies can better perform and reduce emissions at all engine operation conditions than a fuel injection system limited in its control over injection timing, number, quantity and rate shapes. According to the present invention, in order to increase the variability of available injection strategies, a fuel injection system includes at least one fuel injector fluidly connectable to at least a first common rail and a second common rail. By fluidly connecting the fuel injector to the first common rail, fuel can be injected at a first pressure. By fluidly connecting the fuel injector to the second common rail, fuel can be injected at a second pressure that is independent of the first pressure.

20 Claims, 4 Drawing Sheets

U.S. PATENT DOCUMENTS

| | | | | |
|---|---|---|---|---|
| 6,065,450 | A | 5/2000 | Chen et al. | |
| 6,082,332 | A | 7/2000 | Hefler et al. | |
| 6,415,767 | B1 * | 7/2002 | Mahr | 123/456 |
| 6,425,375 | B1 | 7/2002 | Hefler et al. | |
| 6,439,202 | B1 | 8/2002 | Carroll, III et al. | |
| 6,453,875 | B1 | 9/2002 | Mahr et al. | |
| 6,499,465 | B1 * | 12/2002 | Mahr et al. | 123/447 |
| 6,568,369 | B1 | 5/2003 | Desai et al. | |
| 6,575,137 | B2 | 6/2003 | Hefler et al. | |
| 6,684,853 | B1 | 2/2004 | Lei | |
| 6,725,838 | B2 | 4/2004 | Shafer et al. | |
| 6,769,635 | B2 | 8/2004 | Stewart et al. | |
| 6,973,921 | B2 * | 12/2005 | Shafer et al. | 123/495 |
| 6,986,646 | B2 * | 1/2006 | Bettenhausen et al. | 417/53 |
| 2003/0075154 | A1 * | 4/2003 | Potz et al. | 123/456 |
| 2005/0115544 | A1 * | 6/2005 | Kim | 123/456 |

* cited by examiner

FI
TIME

P
TIME

FCV
TIME

NCV
TIME

SAC
TIME

FUEL INJECTION SYSTEM INCLUDING TWO COMMON RAILS FOR INJECTING FUEL AT TWO INDEPENDENTLY CONTROLLED PRESSURES

TECHNICAL FIELD

The present invention relates generally to fuel injection systems, and more specifically to a fuel injection system and a method of injecting fuel using two common rails at different controlled pressures.

BACKGROUND

Engineers are constantly seeking ways to reduce undesirable engine emissions. One strategy is to seek ways to improve performance of fuel injection systems. Over the years, engineers have come to learn that engine emissions can be a significant function of injection timing, the number of injections, injection quantities and rate shapes. However, it has been observed that an injection strategy at one engine operating condition may decrease emissions at that particular operating condition, but actually produce an excessive amount of undesirable emissions at a different operating condition. Thus, a fuel injection system with a variety of capabilities to produce a variety of injection strategies can better perform and reduce emissions at all engine operating conditions than a fuel injection system limited in its control over injection timing, number, quantity and rate shapes. Further, increases in the ability to vary injection rates, injection numbers, injection quantities and rate shapes can lead to more research on, and discovery of, improved injection strategies at different operating conditions.

One apparent attempt to provide a fuel injection system that can quickly vary the pressure of injections is disclosed in "Heavy Duty Diesel Engines—The Potential of Injection Rate Shaping for Optimizing Emissions and Fuel Consumption", presented by Messers, Bemd Mahr, Manfred Durnholz, WilhelmPolach, and Hermann Grieshaber, Robert Bosch GmbH, Stuttgart, Germany, at the 21$^{st}$ International Engine Symposium, May 4–5. 2000, Vienna, Austria. This reference teaches a common rail system and a directly controlled fuel injector that purportedly has the ability to inject medium pressure fuel directly from the rail, or utilize the fuel common rail to pressure intensify fuel within the injectors for injection at relatively high pressures. The magnitude of high pressure of pressure intensified injection will be, in part, a function of the pressure of the fuel acting on a pressure intensifier within the fuel injector.

While this fuel injection system theoretically may have the ability to produce multiple injections, each at different pressures and close in time, the fuel injection system does have drawbacks. For instance, the fuel used to actuate the pressure intensified injection and the fuel being injected directly from the common rail have the same source, i.e., the common rail. Thus, they are both at common rail pressure. In situations in which there is insufficient time to alter the pressure within the common rail between injections, the high pressure of the pressure intensified injection is dependent on the medium pressure injection of the common rail injection, or vice versa. For instance, the pressure of a main injection that is pressure intensified is limited by the pressure of a pilot injection directly injected from the common rail. Thus, although the pressure of the high pressure injection is greater than the pressure of the medium pressure injection, the Bosch fuel injection system lacks the capability to vary the pressure of the high pressure injection without also varying the pressure of the medium pressure injection.

The present invention is directed to increasing the capabilities of fuel injection systems.

SUMMARY OF THE INVENTION

In one aspect of the present invention, a fuel injection system includes at least a first common rail and a second common rail. At least one fuel injector is fluidly connectable with the first common rail and the second common rail. The first common rail is at a first pressure, and the second common rail is at a second pressure that is independent of the first pressure.

In another aspect of the present invention, a fuel injector includes a fuel injector body that defines at least a low pressure outlet, a medium pressure inlet, a high pressure inlet, and a nozzle outlet. A direct needle control valve includes a closing hydraulic surface.

In yet another aspect of the present invention, there is a method of injecting fuel. Fuel is injected at a first pressure, at least in part, by fluidly connecting a fuel injector to a first common rail. Fuel is injected at a second pressure, at least in part, by fluidly connecting the fuel injector to a second common rail. The second pressure is independent of the first pressure.

DETAILED DESCRIPTION

Figure 1:
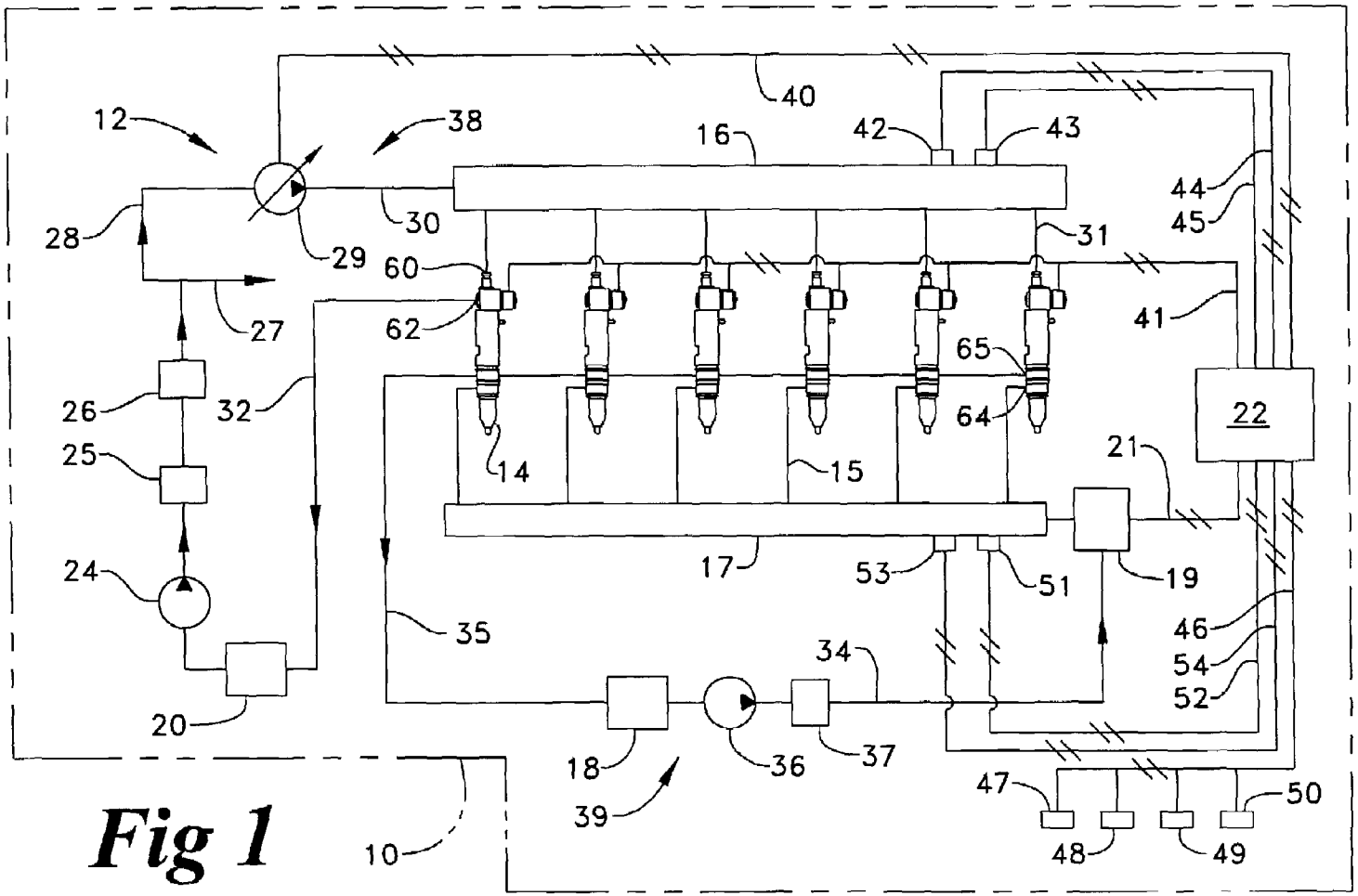
FIG. 1 is a schematic of a fuel injection system according to the present invention.

Referring to FIG. 1, a six cylinder diesel engine 10 includes a double common rail fuel injection system 12. The system 12 includes an individual fuel injector 14 for each engine cylinder, an oil circuit 38 including an oil common rail 16 fluidly connected to an oil sump 20, and a fuel circuit 39 including a fuel tank 18 fluidly connected to a fuel common rail 17. Those skilled in the art will appreciate that in other applications there may be two or more separate oil common rails and/or fuel common rails, such as a separate fuel and/or oil rail for each side of a "V" engine. Although the two common rails 16 and 17 are illustrated as including two different fluids, it should be appreciated that both common rails could include the same fluid, i.e., fuel. Further, it should be appreciated that if both common rails included fuel, both common rails could be fluidly connectable to one another as long as each common rail could deliver fuel to the fuel injectors 14 at a pressure independent of the other common rail. For instance, the common rails could be fluidly connectable to one another and to the fuel injectors with a pressure regulator positioned between the two common rails. In addition, if both rails contained fuel, the present invention contemplates fuel from both common rails being injected directly into the engine cylinder with or without an option of pressure intensification.

An electronic control module 22 controls the operation of fuel injection system 12. The electronic control module 22 preferably utilizes advanced strategies to improve accuracy and consistency among the fuel injectors 14 as well as pressure control in oil common rail 16 and fuel common rail 17. For instance, the electronic control module 22 might employ electronic trimming strategies individualized to each fuel injector 14, to perform more consistently. Consistent performance is desirable in the presence of the inevitable performance variability responses due to such causes as realistic machining tolerance associated with the various components that make up the fuel injectors 14. In another strategy, the electronic control module 22 might employ a model based rail pressure control system that breaks up the rail pressure control issue into one of open loop flow control coupled with closed loop error and pressure control.

When fuel injection system 12 is in operation, oil in an oil fluid circuit 38 is drawn from oil sump 20 by a low pressure oil circulation pump 24, and the outlet flow is split between an engine lubrication passage 27 and a low pressure fuel injection supply line 28 after passing through an oil filter 25 and a cooler 26. The oil in engine lubrication passage 27 travels through the engine 10 and lubricates its various components in a conventional manner. The oil in low pressure supply line 28 is raised to a medium pressure level by a high pressure pump 29. This "medium pressure" is a relatively high pressure compared to oil drain pressure, but still lower than peak injection pressures. Pump 29 is preferably an electronically controlled variable delivery pump, such as a sleeve metered fixed displacement variable delivery pump. Thus, the pump 29 can vary the pressure of the oil being delivered from the pump 29. High pressure pump 29 is connected to common rail 16 via a high pressure supply line 30. Each of the individual fuel injectors 14 have an actuation fluid inlet 60 connected to common rail 16 via a separate branch passage 31. After being used within individual fuel injectors 14 to pressurize fuel, the oil leaves fuel injectors 14 via an actuation fluid drain 62 and returns to oil sump 20 for recirculation via a return line 32.

Fuel is drawn from a fuel tank 18 by a fuel transfer pump 36 and delivered to a high pressure fuel pump 19 via a fuel supply line 34 that includes a fuel filter 37. The fuel transfer pump 36 and fuel filter 37 are preferably contained in a common housing. Fuel transfer pump 36 is preferably a constant flow electric pump, whereas the high pressure fuel pump 19 is preferably an electronically controlled variable delivery pump, such as a sleeve metered fixed displacement variable delivery pump. The high pressure fuel pump 19 pressurizes the fuel to a "medium pressure", and delivers the pressurized fuel to a fuel common rail 17. Although the fuel high pressure pump 19 can vary the pressure of the fuel being delivered from the pump 19, the "medium pressure" of the fuel is less than peak injection pressure. It should be appreciated that the medium pressure of the fuel can be greater or less than the medium pressure of the oil from the oil common rail 16 depending on the desired injection strategy. Each of the fuel injectors 14 have a fuel inlet connected to the fuel common rail 17 via a separate fuel branch passage 15. Any fuel not used by the fuel injectors 14 is recirculated to fuel tank 18 via fuel return line 35, which is connected to low pressure fuel outlet 65.

Fuel injection system 12 is controlled in its operation via an electronic control module 22 via control communication lines 40, 21 and 41. Control communication line 40 communicates with oil high pressure pump 29 and controls its delivery, and hence the pressure in oil common rail 16. Similarly, control communication line 21 communicates with fuel high pressure pump 19 and controls its delivery, and hence the pressure in fuel common rail 17. Control communication line 41 includes four wires, one pair for each electrical actuator within each fuel injector 14. Those skilled in the art will appreciate that by modifying control signals, a single pair of wires could be used to control two electrical actuators. In addition, there may be more wires, such as for carrying feed back signals to the electronic control module. These respective actuators within fuel injectors 14 control flow of actuation fluid to the injectors from rail 16, and the opening and closing of the fuel injector spray nozzle. Electronic control module 22 determines its control signals based upon various sensor inputs known in the art. These include an oil pressure sensor 42 attached to rail 16 that communicates an oil pressure signal via sensor communication line 45, and a fuel pressure sensor 51 attached to rail 17 that communicates a fuel pressure signal via a communication line 52. In addition, an oil temperature sensor 43 and a fuel temperature sensor 53, which are also attached to rail 16 and 17, respectively, communicate an oil temperature signal and a fuel temperature signal to electronic control module 22 via sensor communication lines 44 and 54, respectively. The electronic control module 22 receives a variety of other sensor signals via a sensor communication line(s) 46. These sensors could include but are not limited to, a throttle sensor 47, a timing sensor 48, a boost pressure sensor 49 and a speed sensor 50.

Figure 2:
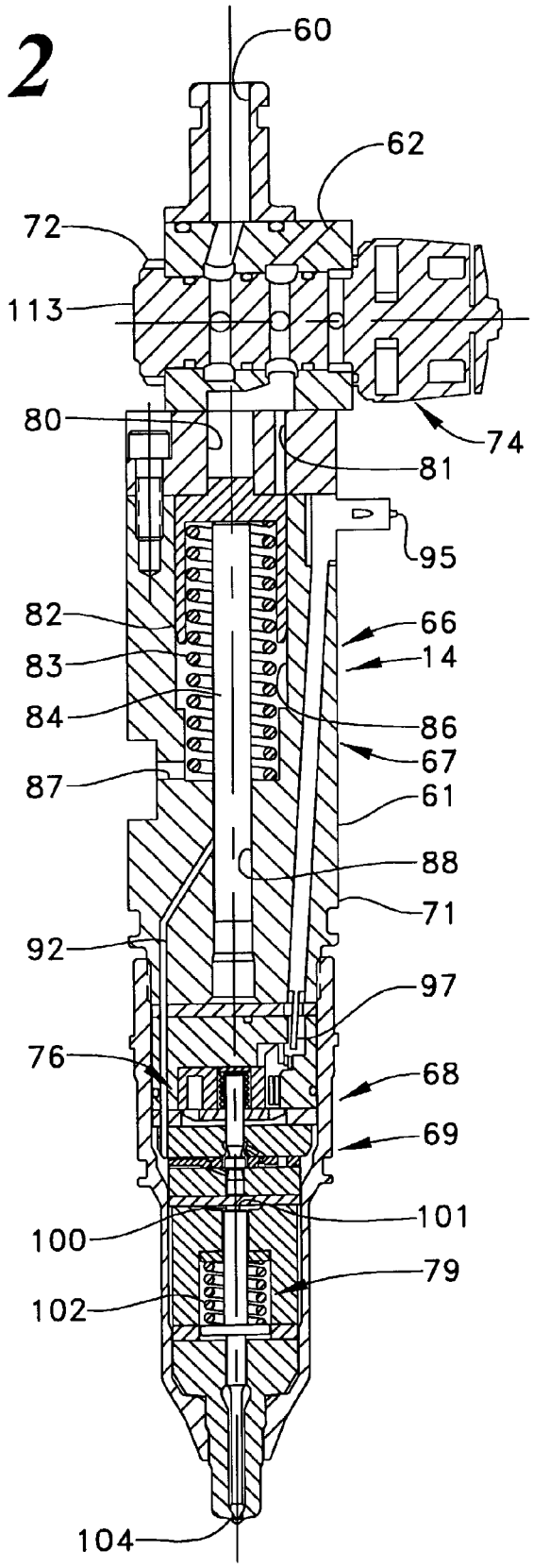
FIG. 2 is a sectioned side diagrammatic view of a fuel injector according to the present invention.
Figure 3:
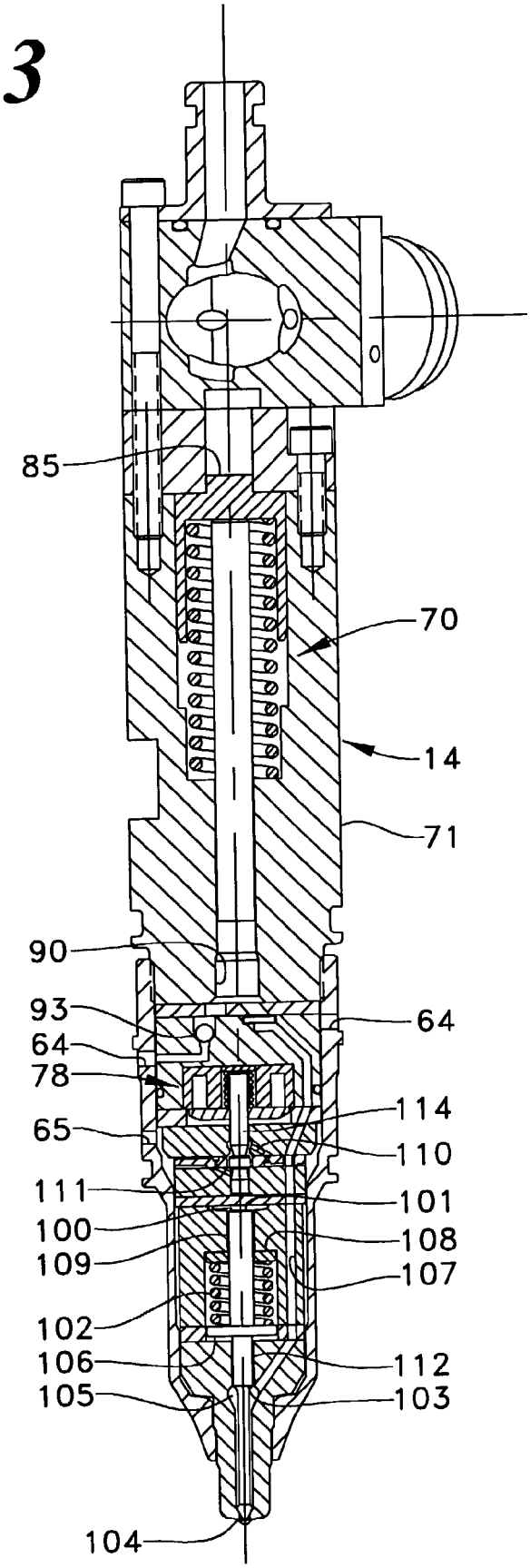
FIG. 3 is the fuel injector of FIG. 2 as viewed along a different section line.

Referring in addition to FIGS. 2 and 3, each fuel injector 14 includes an injector body 61 that can be thought of as including a fuel pressurization portion 66 and an injection portion 68. Fuel injector 14 can also be thought of as being divided between fuel pressurization assembly 67 and a direct control nozzle assembly 69. In the fuel injector 14 illustrated, fuel pressurization assembly 67 is located in fuel pressurization portion 66, whereas direct control nozzle assembly 67 is located in injection portion 68. Although the fuel injector 14 shows the fuel pressurization assembly 67 and the direct control nozzle assembly 69 joined into a unit injector 14, those skilled in the art will appreciate that those respective assemblies could be located in separate bodies connected to one another with appropriate lines. The fuel pressurization assembly 67 includes a pressure intensifier 70 and a flow control valve 74, which is operably coupled to a first electrical actuator 72. Direct control nozzle assembly 79 includes a needle control valve 76 that is operably coupled to a second electrical actuator 78, which is located in and attached to injection portion 68. In addition, a direct control needle valve 79 is controlled in its opening and closing by needle control valve 76, and hence second electrical actuator 78. Pressurized oil enters injector body 61 through its top surface at high pressure actuation fluid inlet 60, and used low pressure oil is recirculated back to the sump 24 via a low pressure actuation fluid drain 62. Fuel is circulated to and from the fuel injectors 14 via a medium pressure fuel inlet 64 and a low pressure outlet fuel outlet 65.

Pressure intensifier 70 includes a stepped top intensifier piston 82 and preferably a free floating plunger 84. Intensifier piston 82 is biased to its retracted position, as shown, by a return spring 83. The stepped top of intensifier piston 82 allows the initial movement rate, and hence possibly the initial injection rate, to be lower than that possible when the stepped top clears a counter bore. Return spring 83 is positioned in a piston return cavity 86, which is vented directly to the area underneath the engine's valve cover via an unobstructed vent passage 87. Free floating plunger 84 is biased into contact with the underside of intensifier piston 82 via low pressure fuel acting on one end in fuel pressurization chamber 90. Plunger 84 preferably has a convex end in contact with the underside of intensifier piston 82 to lessen the effects of a possible misalignment. In addition, plunger 84 is preferably symmetrical about three orthogonal axes such that fuel injector 14 can be more easily assembled by inserting either end of plunger 84 into the plunger bore located within injector body 61. When intensifier piston 70 is undergoing its downward pumping stroke, fuel within fuel pressurization chamber 90 is raised to high pressure injection levels. Any fuel that migrates up the side of plunger 84 is preferably channeled back for recirculation via a plunger vent annulus 88 and a vent passage 92. Pressure intensifier 70 is driven downward when flow control valve 72 connects actuation fluid passages 80/81 to high pressure actuation fluid inlet 60. Between pressure intensified injection events, flow control valve 72 connects actuation fluid passages 80/81 to low pressure drain 62 allowing the intensifier 70 to retract toward its retracted position, as shown, via the action of return spring 83 and fuel pressure acting on the underside of plunger 84. Thus, when pressure intensifier 70 is retracting, fresh fuel is pushed into fuel pressurization chamber 90 past check valve 93 via fuel inlet 64.

Referring in addition to FIG. 4, flow control valve 72 includes the first electrical actuator 74, which in the illustrated embodiment as a solenoid, but could equally be any other suitable electrical actuator known in the art including, but not limited to, piezos, voice coils, etc. Flow control valve 72 includes a valve body that includes separate passages connected to actuation fluid inlet 60, actuation fluid drain 62 and actuation fluid passages 80/81, respectively. Flow control valve 72 includes a spool valve member 113 that is biased to a first position that fluidly connects an actuation fluid passage 80/81 to actuation fluid drain 62. When electrical actuator 74 is energized, the valve member 113 moves to a second position. At this energized position, spool valve member 113 closes the fluid connection between actuation fluid passage 80/81 and drain 62, and opens high pressure inlet 60 to actuation fluid passages 80/81. Control communication line 41 of FIG. 1, electronic control module 22, and electric terminals that are attached to valve body 113 are electrically connected to the electrical actuator 74 in a conventional manner.

When pressure intensifier 70 is driven downward, high pressure fuel in fuel pressurization chamber 90 can flow via nozzle supply passage 107 to the nozzle chamber 105, and out of nozzle outlets 104 if direct control needle valve 79 is in an open position. Further, even when pressure intensifier 70 is in the retracted position, "medium" pressure fuel that flows from the fuel common rail 17 to the fuel pressurization chamber 90 can flow via nozzle supply passage 107 to the nozzle chamber 105, and out of the nozzle outlets 104 if direct control needle valve 79 is in the open position. When direct control needle valve 79 is in its closed position as shown, nozzle chamber 105 is blocked from fluid communication with nozzle outlets 104.

Direct control needle valve 79 includes a needle valve member made up of a needle 112 separated from a piston 109 by a lift spacer 106. Thus, the needle valve member in this embodiment is made up of several components for ease of manufactureability and assembly, but could also be manufactured from a single solid piece. The needle valve member includes an opening hydraulic surface 103 exposed to fluid pressure in nozzle chamber 105 and a closing hydraulic surface 101 exposed to fluid pressure in a needle control chamber 100. The thickness of lift spacer 106 preferably determines the maximum opening travel distance of direct control needle valve 79. The direct control needle valve 79 is biased toward its downward closed position, as shown, by a biasing spring 102 that is compressed between lift spacer 106 and a VOP (valve opening pressure) spacer 108. Thus, the valve opening pressure of the direct control valve 79 can be trimmed at time of manufacture by choosing an appropriate thickness for VOP spacer 108.

Needle control chamber 100 is fluidly connected to either low pressure fuel outlet 65 or to nozzle supply passage 107 depending upon the positioning of needle control valve assembly 76. When needle control chamber 100 is fluidly connected to nozzle supply passage 107, regardless of whether the nozzle supply passage 107 includes high pressure fuel or medium pressure fuel, direct control needle valve 79 will remain in, or move toward, its closed position, as shown, under the action of fluid pressure forces on closing hydraulic surface 101 and the spring force from biasing spring 102. When needle control chamber 100 is fluidly connected to fuel outlet 65, while nozzle supply passage 107 and hence nozzle chamber 105 are above a valve opening pressure, the fluid forces acting on opening hydraulic surface 103 are sufficient to lift the direct control needle valve 79 upward towards its open position against the action of biasing spring 102 to open nozzle outlets 104. It should be appreciated that the nozzle control chamber 100 could be connectable to any passage being at a lower pressure than the "medium" pressure of the fuel common rail 17.

In the illustrated embodiment, the needle control valve 76 is a two position three way valve that includes a needle control valve member 114 that is moveable between contact with a high pressure seat and a low pressure seat. Depending upon the position of valve member 114, needle control chamber 100, is fluidly connected to nozzle supply passage 107 via connection passage 110 or to fuel outlet 65 via low pressure passage 111. A needle control passage (not shown) fluidly connects the needle control chamber 100 to either the connection passage 110 or the low pressure passage 111. Needle control valve 76 includes the second electrical actuator 78 which in the illustrated embodiment is a solenoid subassembly, but could also be another type of electrical actuator, such as a piezo, a voice coil, etc. The solenoid subassembly includes a stator, a coil and a pair of electrical connectors. The female electrical connectors, which could instead be male, permits an electrical extension to mate with solenoid subassembly within injector body 71 while providing exposed terminals for insulated conductors 95 outside of fuel pressurization portion 66. Valve member 114 is biased downward to close a low pressure seat and low pressure passage 111. When the second electrical actuator 78 is energized, valve member 114 opens the low pressure seat (passage 111) and closes the high pressure seat (passage 110).

INDUSTRIAL APPLICABILITY

During each engine cycle, each fuel injector 14 has the ability to inject up to five or more discrete shots. While a majority of these injection events will take place at or near the transition from the compression to power strokes, injection events can take place at any timing during the engine cycle to produce any desirable effect. For instance, an additional small injection even elsewhere in the engine cycle might be useful in reducing undesirable emissions. Although the present invention finds a preferred application in four cycle engines, it could also be used in two cycle engines. For the purposes of illustrating the present invention, the injections discussed will be classified into two categories: (1) pressure intensified injections, generally producing a relatively high pressure injection; and (2) common rail injections, generally producing a relatively low pressure injection. During each engine cycle, a number of basic steps can be performed to create both types of injections or a hybrid of the types of injections, and each of those steps is performed at a timing and in a number to produce a variety of fuel injection sequences.

Referring to FIGS. 4*a*–4*e*, there are shown exemplary graphs illustrating fuel injection rate, plunger movement, flow control valve movement, needle control valve movement and sac pressure versus time, respectively, for an example injection sequence according to the present invention. The example injection sequence includes a pilot injection 115, a main injection 116, and a post injection 117. The pilot injection 115 and the post injection 117 are illustrated as common rail injections, and the main injection 116 is illustrated as a hybrid of a pressure intensified injection and a common rail injection. However, it should be appreciated that the teachings of the present invention can be used to create various injection sequences that include any number of injections at various pressures. For instance, by controlling the timing of the signals to the flow control valve and the needle control valve, a main injection event can include various rate shapes, including but not limited to boot, ramp and square rate shapes. Further, an injection sequence can include more than one pilot and/or post injection, or include no pilot and/or post injection. An injection sequence that may be desirable to reduce emissions at one operating condition may not be desirable at another operating condition. Thus, the electronic control module 22, in a conventional manner, will control the signals to the flow control valve 72, the needle control valve 76, the oil high pressure pump 29, and the fuel high pressure pump 19 in order to create an injection sequence that is desirable for the particular operating condition. It is known in the art that the electronic control module 22 is programmed to determine the proper injection sequence for the particular operating condition based on the sensed parameters being communicated from the various pressure sensors 42, 43, 47, 48, 49, 50, and 51.

Referring also to FIGS. 1–3, prior to the beginning of the example injection sequence, fuel has been drawn from the fuel tank 18 by the fuel transfer pump 36 and delivered to the high pressure fuel pump 19. The high pressure fuel pump 19 will raise the pressure of the fuel to be delivered to the fuel common rail 17. Because the output of the high pressure fuel pump 19 is electronically controlled, the pressure within the fuel common rail 17 is controlled by the electronic control module 22. As discussed earlier, the electronic control module 22, using any method known in the art, will determine the desired pressure at which the pilot injection 115 should occur and adjust the signal to the high pressure fuel pump 19 accordingly. Prior to the injection sequence, oil will have been drawn from the oil sump 20 by the low pressure oil pump 24 and delivered to the high pressure oil pump 29. The electronic control module 29 will determine the desired pressure of the common rail 16 based on the desired pressure of the main injection event 116 and adjust the signal to the oil high pressure pump 29 accordingly. It should be appreciated that the pressure within the fuel common rail 17 and/or the oil common rail 16 could be controlled by apparatuses other than variable delivery pumps, 19 and 29, respectively, including, but not limited to, electronically controlled valves. Further, it should be appreciated that the pressure of the oil within the common rail 16 can be higher or lower than the pressure within the fuel common rail 17 depending on the desired injection sequence. The pressurized oil will be delivered to the fuel injectors 14 via the oil common rail 16 and the branch passages 31, and the pressurized fuel will flow through the supply branches 15 and into the respective fuel injectors 14.

Because the injector 14 is between injection events, the pressure intensifier 70 including the plunger 84 will be either in the retracted position or in the process of retracting. If the plunger 84 is in the process of retracting, the fuel will be drawn into the fuel pressurization chamber 90 past the check valve via 93 the fuel inlet 64. If the plunger 84 has already retracted, the fuel pressure produced by the high pressure fuel pump 19 is sufficient to push the fuel into the fuel pressurization chamber 90 past the check valve 93. Because the needle control valve 76 is biased to open needle control chamber 100 to nozzle supply passage 107, the medium pressure fuel within the nozzle supply passage 107 will be insufficient to open the direct control needle valve 79. Nozzle outlet 104 will remain closed and the fuel will not be injected. Further, because the flow control valve 72 is biased to fluidly connect the actuation passages 80/81 with the actuation fluid drain 62, the plunger 84 will not advance and further pressurize the fuel within the fuel pressurization chamber 90.

In order to initiate the pilot injection 115, the electronic control module 22 will energize the second electrical actuator 78 operably coupled to the needle control valve 76. The needle control valve 76 will move from its biased position blocking the low pressure passage 111. Although the present invention illustrates the needle control valve 76 being biased to block the low pressure passage 111, it should be appreciated that the needle control valve 76 could be biased to block the high pressure passage 110. The closing hydraulic surface 101 of the direct control needle valve 79 will be exposed to low pressure within the fuel drain fluidly connected to the fuel outlet 65, and thus, the pressure of the fuel within the nozzle chamber 105 acting on the opening hydraulic surface 103 of the needle 112 will be sufficient to lift the direct control needle valve 79 against the spring 102 and the low pressure acting on the closing hydraulic surface 101 in order to open the nozzle outlet 104. The fuel from the fuel common rail 17 can then be directly injected into the engine cylinder as the pilot injection 115. Because pilot injections generally are of smaller quantity than the main injection, the lower pressure at which the pilot is being injected can exploited to improve the accuracy of the injection quantity.

Figures 4A, 4B, 4C, 4D, 4E:
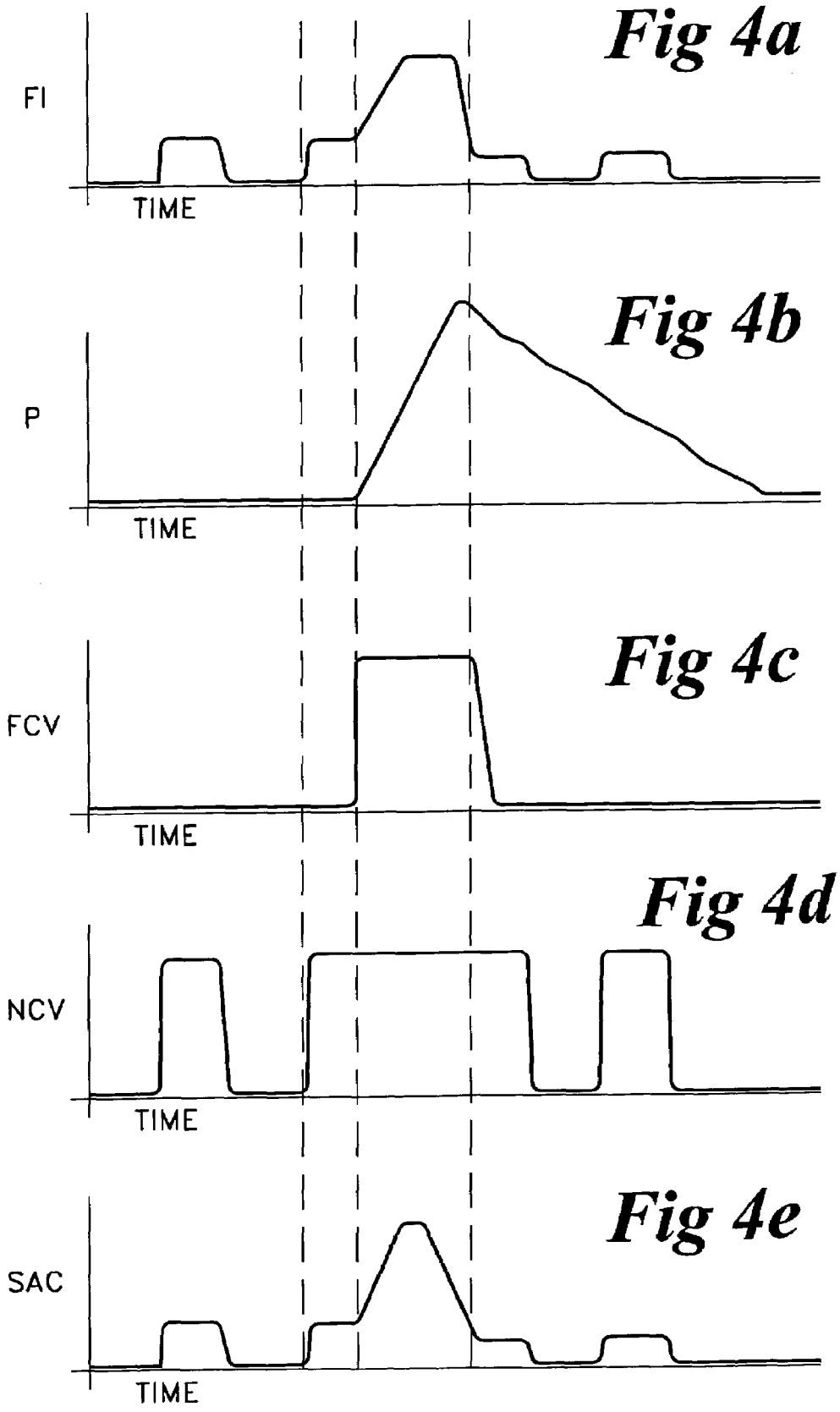
FIGS. 4*a*–4*e* are exemplary graphs illustrating fuel injection rate, plunger movement, flow control valve movement, needle control valve movement and sac pressure versus time, respectively, for an example injection sequence according to the present invention.

In order to end the pilot injection 115, the electronic control module 22 will cease the supply of electric current to the second electrical actuator 78, causing the needle control valve 76 to move to its biased position exposing the closing hydraulic surface 101 of the direct control needle valve 79 to pressure within the nozzle supply passage 107 via passage 110. The pressure acting on the opening hydraulic surface 103 of the direct control needle valve 79 will be insufficient to keep the direct control needle valve 79 open, and the needle 112 will close, blocking the nozzle outlet 104. During the pilot injection 115, FIG. 4*b* illustrates that the plunger 84 of the pressure intensifier 70 does not advance, and FIG. 4*c* illustrates that the flow control valve 72 does not move from its biased position. Further, FIG. 4*e* illustrates that, during the pilot injection 115, the sac pressure, which is the pressure below the tip of the needle 112, is at the common rail pressure.

When the electronic control module 22 determines that the main injection 116 event illustrated in FIG. 4*a* is desirable, the electronic control module 22 will again energize the second electrical actuator 78 via communication line 41. Again, as illustrated by FIG. 4*d*, the needle control valve 76 will move to fluidly connect the needle control chamber 100 to the fuel outlet 65, and thus expose the closing hydraulic surface 101 to low pressure, causing the direct control needle valve 79 to open the nozzle outlet 104. As illustrated in FIG. 4*b*, the plunger 84 still remains in the retracted, biased position, and thus, the pressure within the fuel pressurization chamber 90 is low enough that the fuel from the common rail 17 can flow past the check valve 93 into the fuel pressurization chamber 90 and the nozzle supply passage 107. The fuel from the common rail 17 will be injected into the engine cylinder to begin the main injection event 116.

In the illustrated example, the pressure of the main injection 116 increases over time. In order to increase the pressure, the electronic control module 22 will send electric current to the first electrical actuator 74 operably coupled to the flow control valve 72 while continuing to energize the second electrical actuator 78 operably coupled to the needle control valve 76. As illustrated in FIG. 4*c*, the flow control valve 72 will move from its biased position in which the actuation passages 80/81 are fluidly connected to the fluid actuation drain 62 to its energized position in which actuation passages 80/81 are fluidly connected to the fluid actuation inlet 60. The high pressure oil being delivered to the fuel injector 14 has been pressurize by the high pressure oil pump 29. The high pressure oil flowing from the oil common rail 16 to the fuel injector 14 via the flow control valve 72 will act on the hydraulic surface 85 of the pressure intensifier 70, causing the plunger 84 to advance as illustrated in FIG. 4*b*. As the plunger 84 advances, the pressure of the fuel within the fuel pressurization chamber 90 increases. Due to the increased pressure, check valve 93 closes, and fuel from the fuel common rail 17 cannot flow into the fuel pressurization chamber 90. The fuel within the fuel pressurization chamber 90 will ultimately increase to a relatively high pressure that is a function of the oil pressure acting on the hydraulic surface 85. Thus, the pressure of the main injection 116 results from the electronic control of the high pressure oil pump 29. Although the "high pressure" may vary, the pressure intensified fuel is injected at a higher pressure than the "medium pressure" fuel that is not pressure intensified by the pressure intensifier 70.

The pressure intensified fuel will flow into the nozzle supply passage 107 and act on the opening hydraulic surface 103 of the needle 112. As illustrated in FIG. 4*d*, the needle control valve 76 will, thus, remain in the open position allowing the pressure intensified fuel to be injected into the engine cylinder. As illustrated in FIG. 4*e*, the sac pressure of the main injection 116 has increased from the common rail pressure to the intensified pressure due to the advancement of the plunger 84 during the main injection 116.

In order to decrease the pressure of the main injection 116 to a third pressure, being less than the "medium" pressure of the fuel common rail 17, the electronic control module 22 may cease sending electric current to the first electrical actuator 74 operably coupled to the flow control valve 72. Thus, as illustrated in FIG. 4*c*, the flow control valve 72 will return to its biased position blocking the flow of high pressure oil from the actuation passages 80/81. Because there is not high pressure acting on the hydraulic surface 85, the plunger 84 will retract to its upward position under the return action of the spring 83 and fuel pressure acting on plunger 84. As the plunger 84 retracts, pressure within the fuel pressurization chamber 90 drops, and fuel from the fuel common rail 17 will be drawn in through the fuel inlet and past the check valve 93. Further, as the plunger 84 retracts, the fuel injector 14 will continue to inject fuel from the fuel pressurization chamber 90 and the nozzle supply passage 107 because the direct control needle valve 79 will remain in the open position. Thus, the fuel being injected as the plunger 84 retracts may be injected at a pressure less than the "medium pressure" of the fuel common rail 17 due to the retracting plunger 84. Thus, by injecting fuel as the plunger 84 retracts, fuel can be injected into the engine cylinder at the third, relatively low pressure.

To end the main injection 116, the electronic control module 22 will cease sending electric current to the second electric actuator 78. As illustrated in FIG. 4*d*, the needle control valve 76 will return to its biased position in which the needle control chamber 100 is in fluid communication with the nozzle supply passage 107 and blocked from fluid communication with the fuel outlet 65. Therefore, the pressure within the nozzle supply passage 107 acting on the opening hydraulic surface 103 of the direct control needle valve 79 is insufficient to overcome the pressure acting on the closing hydraulic surface 101 and the bias of the spring 102. Thus, the direct control needle valve 79 will move to the closed position blocking the nozzle outlet 104.

The illustrated injection sequence includes a post injection 117. Although post injections can be of varying quantity, timing, and pressure, post injections often occur with smaller quantities of fuel and at lower pressures than do main injections if possible. In the illustrated example, prior to the post injection 117, both the flow control valve 72 and the needle control valve 76 are in their biased positions. Thus, the plunger 84 is still retracting, and the nozzle outlets 104 are closed. Due to the, retracting plunger 84, the pressure within the fuel pressurization chamber 90 is sufficiently low that fuel can flow past the check valve 93 into the fuel pressurization chamber 90 and the nozzle supply passage 107. In order to initiate the post-injection 117, the electronic control module 22 will energize the second electrical actuator 78. The needle control valve 79 will open fluid communication between the needle control chamber 100 and the fuel drain 65, causing the fuel within the nozzle supply passage 107 to lift the needle 112 and to inject into the engine cylinder. The example shows the post injection event occurring at a relatively low pressure due to the plunger retraction. The electrical actuator 74 coupled to the flow control valve 72 will not be energized. Thus, the plunger 84 will not advance, but will continue retracting as illustrated by FIG. 4*b*, and the post-injection 117 will occur at the "third pressure" below that in the fuel common rail 17 as illustrated by FIG. 4*e*. To end the post injection 117, the electronic control module 22 will stop energizing the second electrical actuator 78 coupled to the needle control valve 79 in order to close the nozzle outlet 104.

The present invention is advantageous because it provides greater variety of fuel injection strategies available to the fuel injection system 12, which may lead to further reduction in undesirable emissions and better performance. Although the operation of the present invention was described for an injection sequence including one pilot injection 115, one post injection 117, and one main injection 116 being injected at varying pressure, the present invention can be used to create injection strategies with varying injection numbers, quantities, and pressures. In fact, the present invention can create a wider variety of injection strategies because the present invention includes two independent means, i.e., the oil high pressure pump 29 and the fuel high pressure pump 19, for controlling the pressure of the injection. For instance, the electronic control module 22 can set the pressure of the pilot injection 115 at the ideal pressure for the particular operating condition by adjusting the signal to the fuel high pressure pump 19. The electronic control module 22 can set the pressure of the main injection 116 at the pressure found to be ideal at the particular operating condition regardless of the pressure of the pilot injection 115 by adjusting the signal to the oil high pressure pump 29. Thus, two injections very close in time, or even one injection, can include two independently selected and controlled pressures, creating a greater variety of possible injection strategies.

Moreover, by providing more variability in the control over fuel injections, engineers can create and test new injection strategies that could lead to even further advancements in performance and undesirable emission reductions. For instance, the present invention provides engineers with the ability to research hybrid pressure injections in which the pressure of the injection changes between the fuel common rail pressure, the intensified pressure and the third pressure being a function of the common rail pressure and the rate of retraction of the plunger. Engineers can adjust the fuel common rail pressure and/or the oil common rail pressure to create a multitude of rate shapes, leading to knowledge about which rate shapes perform better and reduce undesirable emissions at which operating conditions. Further, the present invention is advantageous because it provides more variability over the control of the fuel injection system without requiring significant alterations to the design of the system. Because many fuel injection systems include two separate fluid circuits, the present invention can be implemented by ensuring that needle control valve 76 is fluidly connectable to a pressure source that is lower than the pressure within the fuel common rail so that injections directly from the common rail can occur.

The present invention is also advantageous because it can increase performance of the fuel injection system 12. Because the fuel injection system 12 can inject fuel with or without the use of the pressure intensifier 70, the fuel injection system includes a broad range of pressures at which fuel can be injected. Thus, the fuel injection system 12 can more accurately inject fuel at the pressure required to maintain the desired engine speed and load. For instance, when the vehicle is idling, the pressure intensifier 70 can remain stationary during the entire injection sequence, resulting in an injection at the lower common rail pressure. Further, the operation of the fuel injection system 12 at the common rail pressures can lead to more accurate small injection quantities without demanding that valves exhibit quicker responses to control signals from the electronic control module 22. Thus, at lower pressures, multiple injections can occur closer in time and the greater accuracy.

It should be understood that the above description is intended for illustrative purposes only, and is not intended to limit the scope of the present invention in any way. For instance, if check valve 93 were replaced with a different valve, fuel could be displaced from an injector back to one of the rails to possibly pressurize the same. In other words the injectors could act as unit pumps for one of the common rails. Thus, those skilled in the art will appreciate that other aspects, objects, and advantages of the invention can be obtained from a study of the drawings, the disclosure and the appended claims

What is claimed is:

1. A fuel injection system comprising:

at least a first common rail and a second common rail;

at least one fuel injector fluidly connectable with the first common rail and the second common rail, and each said fuel injector including a spring biased direct control needle valve with an opening hydraulic surface exposed to fluid pressure in a nozzle chamber, and a needle control valve with a valve member movable between contact with a low pressure seat and contact with a high pressure seat;

a check valve fluidly positioned between the second common rail and the nozzle chamber; and the first common rail being at a first pressure and the second common rail being at a second pressure independent of the first pressure, and the second pressure being sufficiently high to produce an opening force on the opening hydraulic surface to overcome the spring bias.

2. The fuel injection system of claim 1 including a first fluid circuit and a second fluid circuit; and the first fluid circuit including the first common rail and the second fluid circuit including the second common rail.

3. The fuel injection system of 2 wherein one of the first fluid circuit and the second fluid circuit holds fuel and the other holds a fluid different from fuel.

4. The fuel injection system of claim 1 wherein at least one of the first fluid circuit and the second fluid circuit include at least one pressure controller; and an electronic control module in control communication with the at least one first pressure controller.

5. The fuel injection system of claim 4 wherein the at least one pressure controller includes a first pressure controller included in the first fluid circuit and a second pressure controller included in the second fluid circuit; and the first pressure controller being a part of a first electronically controlled variable delivery pump and the second pressure controller being part of a second electronically controlled variable delivery pump.

6. The fuel injection system of claim 1 wherein the fuel injector includes a pressure intensifying portion and an injection portion.

7. The fuel injection system of claim 6 wherein the pressure intensifying portion includes a pressure intensifier hydraulic surface and a fuel pressurization chamber; and the first common rail being fluidly connectable with the pressure intensifier hydraulic surface and the second common rail being fluidly connectable with the fuel pressurization chamber, which is fluidly located between the check valve and the nozzle chamber.

8. The fuel injection system of claim 7 including a first fluid circuit and a second fluid circuit including different fluids;

the first fluid circuit including the first common rail and a first electronically controlled variable delivery pump; and the second fluid circuit including the second common rail and a second electronically controlled variable delivery pump.

9. The fuel injection system of claim 1 wherein each fuel injector includes:

a fuel injector body defining at least a low pressure outlet, a medium pressure inlet, a high pressure inlet, and a single nozzle outlet set; and the direct control needle valve including a closing hydraulic surface and a single needle valve member to open and close the single nozzle outlet set.

10. The fuel injection system of claim 9 wherein the closing hydraulic surface being exposed to fluid pressure in a needle control chamber; and the low pressure outlet being fluidly connectable to the needle control chamber.

11. The fuel injection system of claim 9 including a pressure intensifying portion including a pressure intensifier; and the pressure intensifier including a hydraulic surface being fluidly connectable to the high pressure inlet.

12. The fuel injection system of claim 11 including a fuel pressurization chamber; and the medium pressure inlet being fluidly connectable to the nozzle outlet via the fuel pressurization chamber.

13. The fuel injection system of claim 12 wherein the closing hydraulic surface being exposed to fluid pressure in a needle control chamber; and the low pressure outlet being fluidly connectable to the needle control chamber.

14. A method of operating a fuel injection system that includes at least a first common rail and a second common rail; at least one fuel injector fluidly connectable with the first common rail and the second common rail; and the first common rail being at a first pressure and the second common rail being at a second pressure independent of the first pressure; the method comprising the steps of:

maintaining pressure in the first common rail independent from pressure in the second common rail;

injecting fuel at a first pressure, at least in part, by fluidly connecting the fuel injector to the first common rail, and closing a check valve fluidly positioned between a nozzle chamber of the fuel injector and the second common rail;

injecting fuel at a second pressure independent of the first pressure, at least in part, by fluidly connecting the fuel injector to the second common rail, and opening the check valve; and at least one of the injecting steps includes a step of moving a needle control valve member from contact with a low pressure seat to a position in contact with a high pressure seat.

15. The method of claim 14 including a step of ending an injection event at least in part by applying high pressure to a closing hydraulic surface of a direct control needle valve.

16. The method of claim 14 wherein the step of injecting at the second pressure includes a step of delivering fluid at the second pressure from the second common rail to the single nozzle outlet set of the fuel injector.

17. The method of claim 14 wherein the step of injecting at the first pressure includes a step of advancing a pressure intensifier positioned within the fuel injector, at least in part, by exposing a hydraulic surface of the pressure intensifier to fluid delivered from the first common rail.

18. The method of claim 17 including a step of injecting fuel at a third pressure, at least in part, by fluidly connecting the fuel injector to the second common rail as the pressure intensifier is retracting.

19. The method of claim 14 wherein the step of injecting fuel at the second pressure includes a step of controlling the second common rail pressure independently from controlling the first common rail pressure, at least in part, by fluidly isolating the first common rail from the second common rail.

20. The method of claim 14 including a step of displacing fluid from a fuel injector to one of said first and second common rails.

* * * * *

UNITED STATES PATENT AND TRADEMARK OFFICE

CERTIFICATE OF CORRECTION

PATENT NO. : 7,219,655 B2
APPLICATION NO. : 10/377330
DATED : May 22, 2007
INVENTOR(S) : Shinogle It is certified that error appears in the above-identified patent and that said Letters Patent is hereby corrected as shown below:

In Column 12, Line 18, in Claim 3, after “system of” insert -- claim --.

In Column 12, Line 21, in Claim 4, after “claim” delete “1” and insert -- 2 --, therefor.

In Column 12, Line 23, in Claim 4, before “at least” delete “include” and insert -- includes --, therefor.

In Column 12, Line 25, in Claim 4, after “one” delete “first”.

In Column 12, Line 34, in Claim 6, after “wherein the” insert -- at least one --.

In Column 13, Line 9, in Claim 12, after “outlet” insert -- set --.

Signed and Sealed this

First Day of July, 2008

JON W. DUDAS
*Director of the United States Patent and Trademark Office*